US006688145B2

(12) United States Patent
Tan

(10) Patent No.: US 6,688,145 B2
(45) Date of Patent: Feb. 10, 2004

(54) SPORTSBOARD LOCKING APPARATUS AND METHOD

(76) Inventor: Calvin Conrad Tan, P.O. Box 6233, Laguna Niguel, CA (US) 92607-6233

( * ) Notice: Subject to any disclaimer, the term of this patent is extended or adjusted under 35 U.S.C. 154(b) by 0 days.

(21) Appl. No.: 10/241,845

(22) Filed: Sep. 13, 2002

(65) Prior Publication Data

US 2003/0094022 A1 May 22, 2003

Related U.S. Application Data

(60) Provisional application No. 60/335,851, filed on Nov. 16, 2001.

(51) Int. Cl.[7] ..... E05B 69/00
(52) U.S. Cl. ..... 70/58; 70/14; 441/74
(58) Field of Search ..... 70/14, 18, 19, 70/54–58, 150, 164, 166; 441/74, 75

(56) References Cited

U.S. PATENT DOCUMENTS 3,091,011 A * 5/1963 Campbell ..... 70/58 X
3,101,695 A * 8/1963 Honeyman, Jr. ..... 114/230
4,112,716 A * 9/1978 Wippich ..... 70/52 X
4,340,376 A * 7/1982 Williams ..... 441/74
4,366,605 A * 1/1983 McKenney ..... 24/230.5 R
4,407,146 A * 10/1983 Nielsen, Jr. ..... 70/18 X
4,680,949 A * 7/1987 Stewart ..... 70/14
4,712,394 A * 12/1987 Bull ..... 70/18
4,820,220 A * 4/1989 Fruzzetti et al. ..... 441/74
4,938,040 A * 7/1990 Humphreys, Jr. ..... 70/58
4,938,725 A * 7/1990 Beck ..... 441/75
5,109,683 A * 5/1992 Cartwright ..... 70/14
5,119,649 A * 6/1992 Spence ..... 70/14
5,127,861 A * 7/1992 Ross ..... 441/75
5,582,043 A * 12/1996 McCue et al. ..... 70/58
5,582,044 A * 12/1996 Bolich ..... 70/58
5,706,680 A * 1/1998 Wroble ..... 70/18
5,787,740 A * 8/1998 Huebner ..... 70/58
5,832,754 A * 11/1998 McKenzie ..... 70/58
D417,133 S * 11/1999 Niswanger ..... D8/331
6,003,348 A * 12/1999 McCrea ..... 70/18
6,006,557 A * 12/1999 Carl et al. ..... 70/58
6,082,154 A * 7/2000 MacDonald ..... 70/18
6,142,313 A * 11/2000 Young ..... 70/58 X
6,155,088 A * 12/2000 Murray, Jr. et al. ..... 70/58
6,163,935 A * 12/2000 Hinkey ..... 24/71 TD

* cited by examiner

*Primary Examiner*—Suzanne Dino Barrett
(74) *Attorney, Agent, or Firm*—Raymond Y. Chan; David and Raymond Patent Group

(57) ABSTRACT

A sportsboard locking apparatus for securing sportsboard from theft includes a simple, multiple element apparatus which engages elements of a standard sportsboard and further provides for a method by which the sportsboard may be secured to a stationary article avoiding theft. The apparatus operates simply with few moving parts and fits standard sportsboard designs. A cross bar is intimate to the sportsboard's body and located within a cylindrical cup which is recessed below the sportsboard's outer surface, the cross bar being securely fixed to the board's core structure. The apparatus incorporates a hooked element which surrounds the crossbar and a pin element which encloses the cross bar within a space formed between pin and hook element's engagement end. While the hook and pin elements enclose the cross bar below the sportsboard's outer surface, the apparatus's elements positioned above the sportsboard's outer surface insure firm, secure engagement between apparatus and sportsboard. Importantly, the apparatus elements above the outer surface of the sportsboard are free to rotate or spin independent of the hook element and about the pin element's axis without affecting the engagement between apparatus and sportsboard. The apparatus engaged sportsboard may be secured to a stationary article to prevent the sportsboard's unauthorized movement utilizing padlock and security cable elements.

20 Claims, 4 Drawing Sheets

SPORTSBOARD LOCKING APPARATUS AND METHOD

CROSS REFERENCE OF RELATED APPLICATION

This is a regular application of a provisional application, application No. 60/335,851, filed Nov. 16, 2001.

BACKGROUND OF THE PRESENT INVENTION

1. Field of Invention

The present invention relates to a sportsboard, and more particularly to a locking apparatus and method for a sportsboard.

2. Description of Related Arts

Sports and recreational activities involving a board apparatus onto which a recreational user mounts and propels himself and the board along surfaces of water or snow have a large consumer and professional base of participation worldwide. Activities involving such boards include but are not limited to: surfing, wind sailing/surfing, wake riding, snowboarding, kayaking, skating and the like. The board device utilized in such activities will be collectively referred to herein as a sportsboard.

Developments in the sportsboard's functional and appearance features; the board's inherent performance; and general quality of materials and manufacture require participants to make substantial monetary investments in the sportsboard apparatus. Yet the size, structure and fragility of materials used in the sportsboard's manufacture does not lend the sportsboard to readily be secured by the activity participant from theft, particularly in the outdoor environment of such recreational activities, i.e. beach, waterfronts, parks, mountain trails, etc.

Efforts to secure sportsboards and the like in these outdoor, recreational environments have included: methods of wrapping or sandwiching substantial planar portions of the sportsboard in metal plates, cables and the like secured to stationary articles; and to utilize devices intended to be attached to hardware comprising the sportsboard itself. These methods and devices have disadvantages including: they are cumbersome to use; limited in practicality and effectiveness; and requiring the use of custom sportsboard design features, thereby inhibiting their widespread use and effectiveness with sportsboards having standard design features.

U.S. Pat. No. 5,119,649 to Spence describes and claims a lock apparatus attachable to a cross bar positioned in a surfboard article, the apparatus locking thereto and including a cable attaching the surfboard to a stationary article. This Spence '649 apparatus utilizes the surfboard's deck plug cross bar the purpose of which is for attaching a nylon or like cord thereto, the cord serving as a leash type tether upon its attachment to the user's ankle. Thus, the locking device must be compatible with, and not interfere with, such leash cord or its functioning as the '649 apparatus surrounds the crossbar within the annular space between the apparatus's outer casing and the deckplug recess's inner surface. In this regard, the apparatus described in the '649 patent functions with little regard for protecting the leash cord tether. This is evident from FIGS. 1–3 and the close quartered interaction of a notched bolt end sliding concentric to an outer casing and interacting with casing end slots to surround the cross bar within the close quartered plug recess.

An additional shortcoming of the '649 apparatus involves the environmental and confined space in which its multiplicity of close tolerance, moving parts function, namely the harsh and corrosive environments including natural and salt water and abrasive sand and dirt particles. The presence of corrosion and salt residue, dirt or sand within or between the apparatus's moving part surfaces invite wear and inhibited motion or seizing during device operation. Further, the engagement end of the apparatus's casing end limits its use to deck plug recesses that are formed as flat-ended cylinders dimensioned compatibly with the device's engagement end. This engagement end will not functional nor engage crossbars within curved, spherical ended cylinders found in many standard sportsboard designs. Thus, the Spence device is limited to use with flat-ended bottom deck plug designs.

U.S. Pat. No. 5,832,754 to McKenzie discloses a locking device for surfboards including: a hooked end ratchet blade for engaging the surfboard's cross bar, a device plug to engage flush with the deck surface of the board, and a mechanism within the plug to lock the ratchet blade thereby locking the device to the deck plug cross bar and further employing a cable for subsequent attachment of the assembly to a stationary object to prevent theft.

The '754 device relies upon the ratchet blade to pass through the device plug and to slide-ably engage a locking mechanism utilizing the blades teeth. This must be accomplished in the salt water and sand environments the surfboard encounters. Here, corrosion and salt residue, sand, and dirt within or between the device's moving parts invite wear and inhibited motion or seizing during device operation.

Although the McKenzie device recognizes the importance of not interfering with the standard leash cord within and without the cup recess, its notch at the bottom edge of the device plug provides inadequate accommodation to the leash cord as evidenced by the requirement that the bottom surface of the device plug is sufficiently large to completely cover the cup recess to prevent thieves from prying the cup out of the recess.

SUMMARY OF THE PRESENT INVENTION

The present invention discloses a sportsboard locking apparatus to be secured to standard design features on such sportsboards, namely a fixed cross bar within a recessed plug located below the outer surface of the sportsboard and intimate with the board's core body. The term sportsboard is intended to include but not be limited to board devices useful in activities such as: surfing, wind sailing/surfing; wake riding, snowboarding, kayaking, skating and the like.

In the preferred version of the invention, a simple, robust hook and a pin element combine to enclose the cross bar within the recessed plug volume. The positioning of the pin element proximal to the hook element is completed with minimal interaction with the cross bar or its leash cord. While the locking apparatus is comprised of simple parts with limited moving interaction between elements, the cross bar is securely engaged below the sportsboard's outer surface while those apparatus elements above the board's outer surface are free to rotate independent of the hook and pin elements. The low profile and footprint of the engaged apparatus does not adversely affect the board's outer surface from interacting with other objects, i.e. stacked boards, locating on carry racks, etc.

While the assembled locking apparatus is flush to the outer surface of the sportsboard, its design accounts for the presence and function of the standard leash cord tether and does not adversely occlude the recessed plug's opening nor damages the leash cord tether. Once the primary mechanical elements of the locking apparatus intimate to the sportsboard are engaged, a padlock and cable are introduced to provide a means of securing the sportsboard to a stationary article via the locking apparatus.

The device is inexpensive to manufacture and assemble due to the simple design and functioning of its parts. The simple interaction of the apparatus's parts and ancillary security elements minimizes sportsboard engagement steps and makes it easy to use.

Therefore, it is an object of the preferred embodiment of the present invention to overcome the shortcomings of the prior art with numerous benefits and advantages inherent in the form and function disclosed herein including:

Given the salt, sand and dirt the environments to which such sportsboards are exposed, the present invention features simple part design with limited moving interaction so that these environments are not likely to invite wear, inhibit motion, nor experience seizing of parts during device operation.

While firmly engaging the sportsboard's cross bar recessed below the board's outer surface, the apparatus's elements above the board's outer surface are free to rotate and spin relative to the cross bar therein. Unlike prior devices which grip surfboard elements such as the cross bar, the present device's rotation and spin features relative to the cross bar limit rocking motion and prevent twisting motions which would act to pull the recessed plug from the sportsboard's body in an effort to damage or steal a locked sportsboard.

Exposure of the leash cord tether to wear or damage is minimized since: the hook and pin elements which engage the cross bar are positioned in a simple manner that does not require deliberate care in interaction; although flush with the outer surface of the sportsboard, the apparatus above the outer board surface rotates or spins independent of the hook and pin elements engaging the cross bar thereby limiting adverse interaction; the opening of the recessed plug at the sportsboard's surface is not adversely occluded thereby limiting the opportunity for damage.

The apparatus's design and manner in which it engages the cross bar permits its use with multiple deck plug designs including those plugs utilizing flat bottom or flat ended cylinders as well as curved, spherical ended cylinders. This enables the present apparatus to be used with more than custom sportsboards and improves its widespread acceptance and ease of use.

The limited number of components involved, the simple design features and their limited interaction, and the limited assembly requirements of the present apparatus carry a modest cost of raw materials, manufacture and assembly while its adaptability to varied types of sportsboards is great without requiring custom modifications and presents an affordable product that is easy to use.

DETAILED DESCRIPTION OF THE PREFERRED EMBODIMENT

Figure 1:
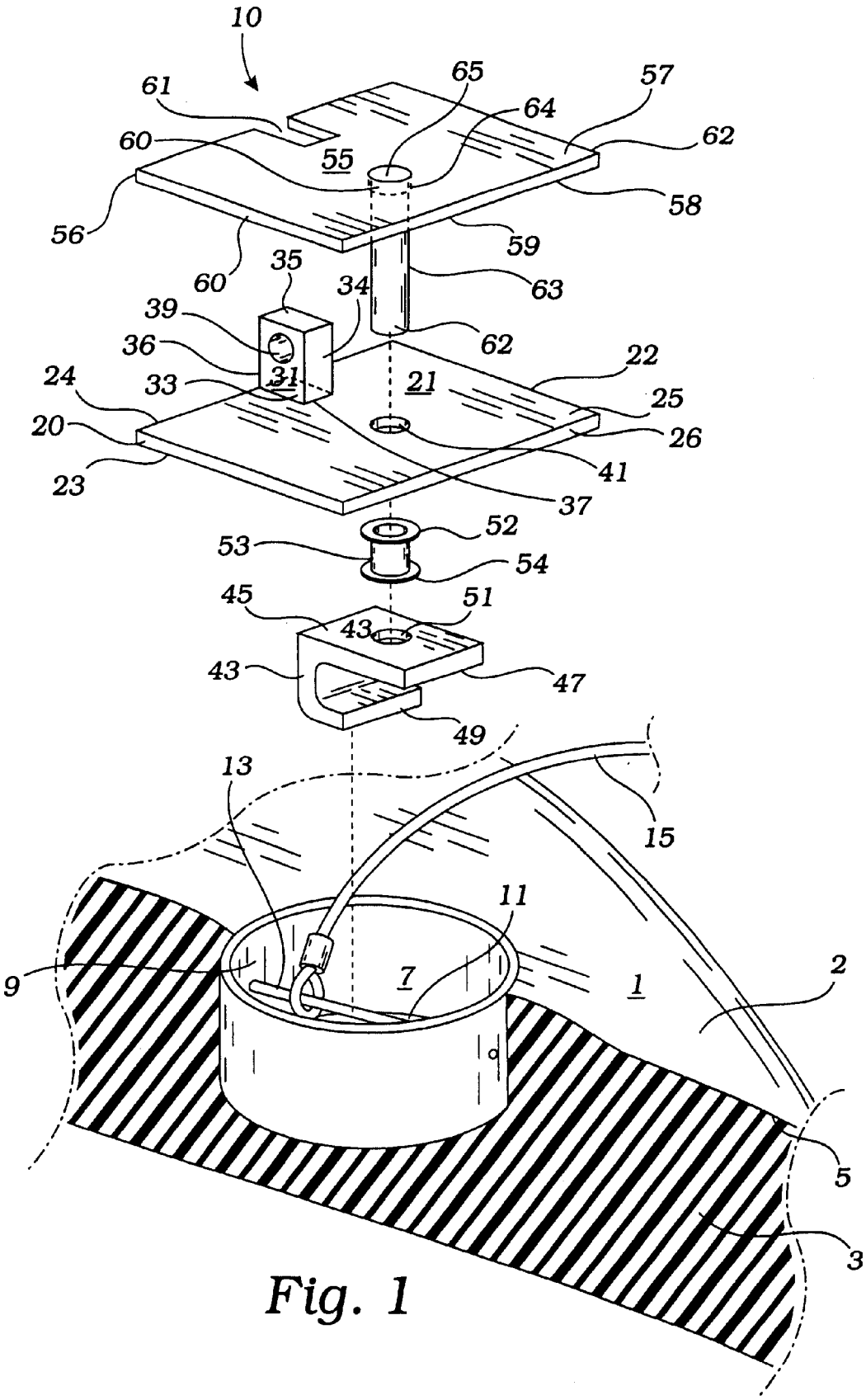
FIG. 1 is a side view of the inventive locking apparatus in relation to a representative sportsboard with the inventive elements juxtaposed and un-engaged with each other or the sportsboard for illustration clarity.

FIG. 1 illustrates an embodiment of the present invention, a locking apparatus 10 for sportsboards, as the apparatus's elements are un-engaged above the sportsboard 1's deck surface 2. The sportsboard consists of a center core 3 and core skin 5, contains within its center core body a recessed and cylindrical shaped deck plug 7 having inner sidewall 9 and inner bottom 11. A crossbar 13 extends across the axial diameter of deck plug 7 and is fixed at its ends diametrically to sidewall 9 between deck surface 2 and deck plug bottom 11. A leash cord 15 of nylon or similar, resilient material is shown attached to cross bar 13 and acts to connect or tether sportsboard 1 to the activity user.

Figure 2:
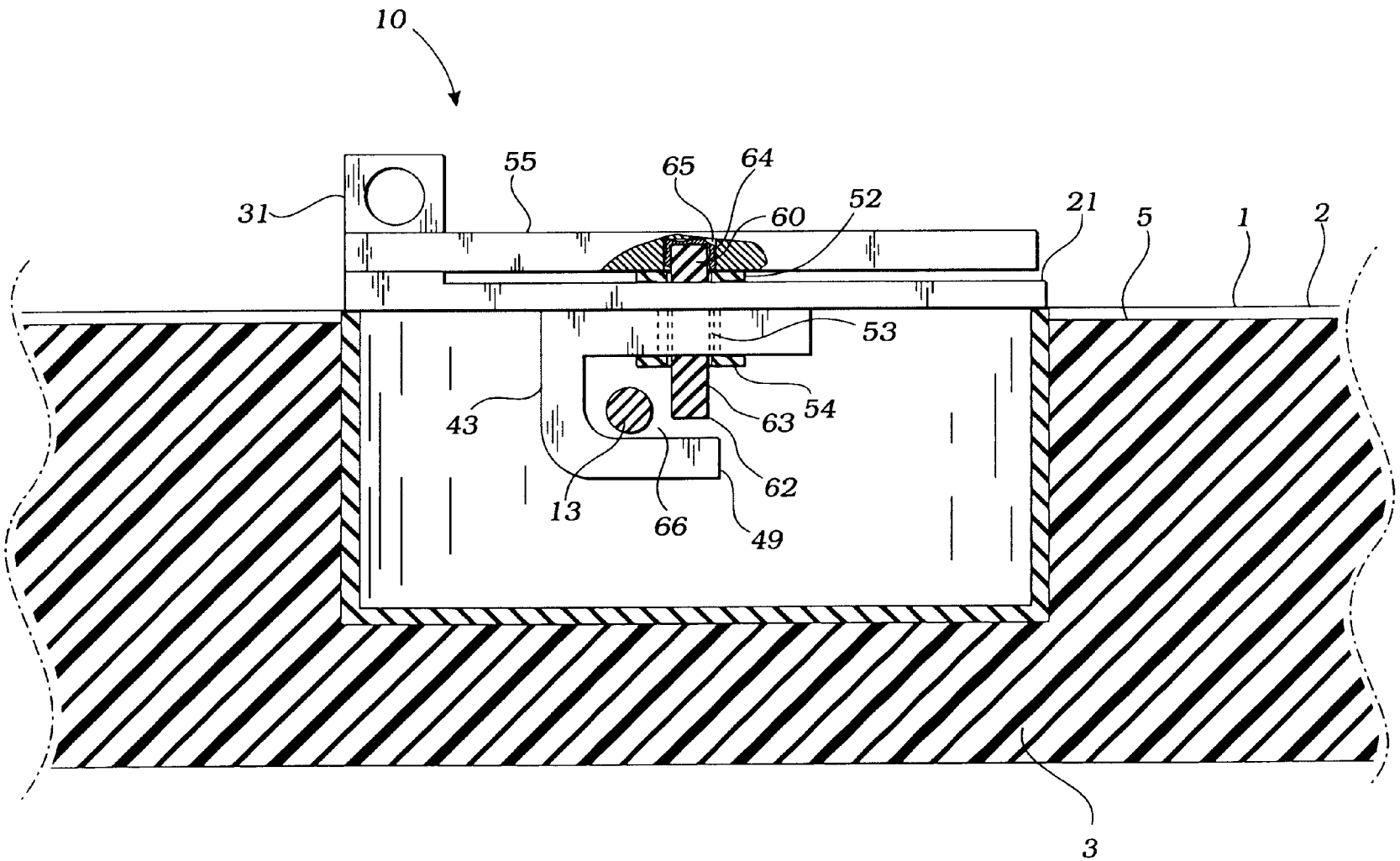
FIG. 2 is a side view of the inventive locking apparatus in relation to a representative sportsboard with the inventive elements engaged to themselves and the sportsboard.

A side view of the locking device 10 is shown in FIG. 2 after engaging the sportsboard 1 's cross bar 13.

Referring to FIGS. 1 and 2, a first horizontal member 21 is shown having a lower surface 23 and an upper surface 25, a first end 24 and a second end 26, a first side 20 and a second side 22. Although any general shape adequate to span deck plug 7's diameter and to sufficiently overlap deck surface 2 will suffice for member 21, the preferred embodiment of horizontal member 21 is of rectangular shape and having length and width perimeter dimensions of between ⅛ to 6 inches and thickness of between 1/16 and 4 inches and having chamfered or rounded edges at the corners and edge junctions at which surface 23 meets ends 24 and end 26 and sides 20 and 22.

A vertical member 31 is shown having a lower surface 33 and an upper surface 35, and forward surface 34 and rear surface 36. Although any general shape is adequate, the preferred embodiment of vertical member 31 is of rectangular shape and having length and width perimeter dimensions of between ⅛ to 6 inches and thickness of between 1/16 and 4 inches.

Vertical member 31 is located in intimate contact at end 24 of horizontal member 21. In one embodiment, members 21 and 31 are formed from two pieces wherein surface 33 and 25 are in intimate contact and securely fixed to each other by attachment means 37 such that members 21 and 31 form an integral piece. In a preferred embodiment, members 21 and 31 are formed from a single piece such that no lower surface 33 nor means 37 exists, rather member 31 emanates from member 21's upper surface 25. In either embodiment, member 31 contains slot 39 located proximal to upper surface 35 and between surfaces 34 and 36. Although any cross-section shape adequate to accept a padlock shackle or similar device will suffice, in the preferred embodiment, slot 39 is circular having diametric dimensions of between 1/16 and 3 inches.

Horizontal member 21 shown contains bore 41 extending from surface 25 through the thickness of member 21 to surface 23 and is located central to ends 24 and 26 and sides 20 and 22 of member 21. As shown, a hook element 43 containing an upper surface 45, a lower surface 47, an engagement end 49, and containing a bore 51 is located such that lower surface 23 of 21 is in intimate contact with upper surface 45 of element 43 and such that bore 51 of element 43 is axially concentric with bore 41 of member 21. Although any cross section shape adequate to accept an attachment means such as subsequently described, in the preferred embodiment, both bore 41 and bore 51 are of circular cross section having diametric dimension of between 1/16 and 4 inches. Engagement end 49 terminates such that the diameter of cross-section cross bar 13 would be contained within the space formed from the point bore 51 exits surface 47 and engagement end 49 terminates.

Hook element 43 is robust with a footprint area at its surface 45 such that it is maximized to fit within the circular area of deck plug 7 without interfering with the presence of cross bar 13 or leash cord 15. Horizontal member 21 is rotate-ably connected to a hook element 43 by means 53, means 53 being axially concentric within bores 41 and 51, means 53 allowing hook element 43 to rotate about the center axis of bores 41 and 51 while maintaining firm, mechanical connection between horizontal member 21 and hook element 43. In one embodiment, means 53 is comprised of a hollow, tubular eyelet having a lip 52 formed against surface 25 and having a lip 54 formed against surface 47, the body of eyelet 53 being concentric to bores 41 and 51. In a second embodiment, means 53 is comprised of a hollow rivet having a lip 52 and lip 54 and concentric to bores 41 and 51.

In an alternative embodiment, hook element 43 is formed from one piece with horizontal element 21 rather than 43 and 21 being separate, connected pieces. In this embodiment, connection means 53 is eliminated. Likewise, bores 41 and 51 are no longer separate elements of 21 and 43 respectively, rather bore 41 extends from upper surface 25 to surface 47 of hook element 43.

Shown in FIGS. 1 and 2 is second horizontal member 55. Although any general shape adequate to span deck plug 7's diameter and to sufficiently overlap deck surface 2 will suffice, in the preferred embodiment, member 55 is rectangular in shape, having length and width perimeter dimensions of between ⅛ to 6 inches and having thickness of between 1/16 to 4 inches, and preferably sized to dimensions identical with the perimeter length and width dimensions of member 21. Horizontal member 55 has a first end 56, a second end 58, a first side 60, and a second side 62, and having an upper surface 57 and a lower surface 59 and having a bore 65 within 55's thickness between surfaces 57 and 59. Lower surface 59 of member 55 locates against upper surface 25 of horizontal member 21.

Member 55 has a slot 61 located at first end 56, centered between sides 60 and 62, and extending through the thickness of member 55 from surface 57 to surface 59. In the preferred embodiment, slot 61 is rectangular in shape and slot 61's interior dimensions are shaped to match mating dimensions of element 31 and sized to be slightly larger than the horizontal dimension and thickness of vertical member 31 such that slot 61 freely accepts vertical member 31 without interference as member 55 locates against horizontal member 21 as shown in FIGS. 1 and 2.

Pin 63, having ends 50 and 62, extends from within bore 65 and from lower surface 59 of locking member 55. The length of pin 63 extends from its end 50 to below the surface 59 of 55, concentrically through bore 41 and through the thickness of horizontal member 21, and concentrically through bore 51 to below surface 47 of hook element 43 to pin end 62 proximal to end 49 of hook element 43. As shown in FIG. 2, when fully inserted through bores 41 and 51, end 62 of pin 63 encloses cross bar 13 within the space 631 formed between pin 63 and hook end 49.

In an alternate embodiment, pin 63 is sufficient in length and bores 65, 41, and 51 concentrically align such that pin end 62 terminates forward of hook end 49 as it is shown in FIG. 2. In both embodiments, cross bar 13 is enclosed within space 631 formed by pin 63 and hook end 43.

In the preferred embodiment, pin 63 is formed from a piece separate from member 55 and is located into bore 65 of member 55 by means 64 such that end 50 of pin 63 is firmly attached within member 55 so that pin 63 is not free to rotate. In one such embodiment of means 64, the cross-sectional dimensions of pin 63 are nearly those of bore 65 whereby a press-fitting means 64 is used to insert pin 63 into the recess of bore 65 thereby fixing pin 63 at end 50 to member 55. Alternatively, an adhesive bonding, welding, male-female screw thread, threaded end and nut or other means 64 can be employed to fix pin 63 to 55 at its end 50 of pin 63. In an alternative embodiment, pin 63 is integrally formed with member 55 as a single piece rather than separate pieces thereby obviating bore 65 and means 64.

In the preferred embodiment, pin 63 is shaped to match the cross section of bores 41 and 51, preferably circular or round, and is sized to a slightly smaller diameter or cross section than means 53 connecting members 21 and 43 such that pin 63 can fit without interference while inserted concentrically within the diameter or cross section of means 53. Thus members 21 and 55 are allowed to rotate or spin relative to hook element 43 as bar 13 is engaged by pin 63 and hook end 49 within space 631.

Figure 3:
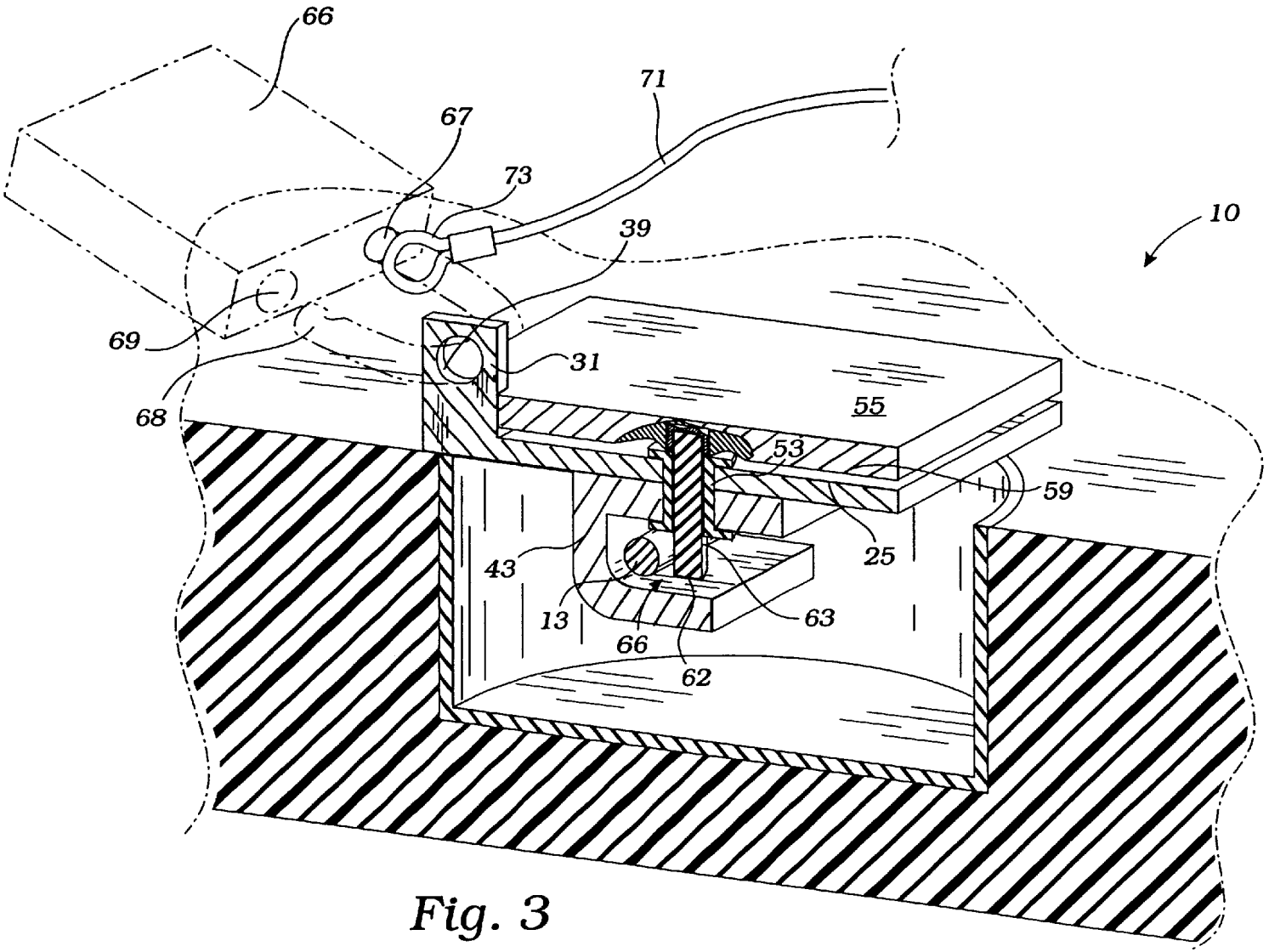
FIG. 3 is a perspective view of the locking apparatus illustrating a method for securing the engaged locking device by means of a security padlock.

In the preferred embodiment, when lock member 55's lower surface 59 is in contact with upper surface 25 of member 21, the bore 39 of vertical member 31 has its entire circular cross section exposed as shown in FIG. 2. Additional steps are required to engage locking apparatus 10 such that it is securely fixed to board 1 while cross bar 13 is enclosed or engaged. As illustrated in FIG. 3, a standard pad lock 66 having shackle 67 and housing 69 engages lock apparatus 10 by passing shackle 67 through bore 39 of vertical member 31. Alternatively, devices other than a padlock shackle can be used to engage apparatus 10 with board 1 such as a security cable, security bar, or similar device.

Prior to inserting free end 68 of shackle 67 into lock housing 69 thereby locking pad lock 66, shackle 67 is passed through at least one hooped end 73 of cable 71. Cable 71 is comprised of single or multiple wires of metal or similarly performing cable known in the art for securing articles from theft or unwanted movement. Alternatively, at least two hooped ends 73 of cable 71 are engaged by shackle 67.

Figure 4:
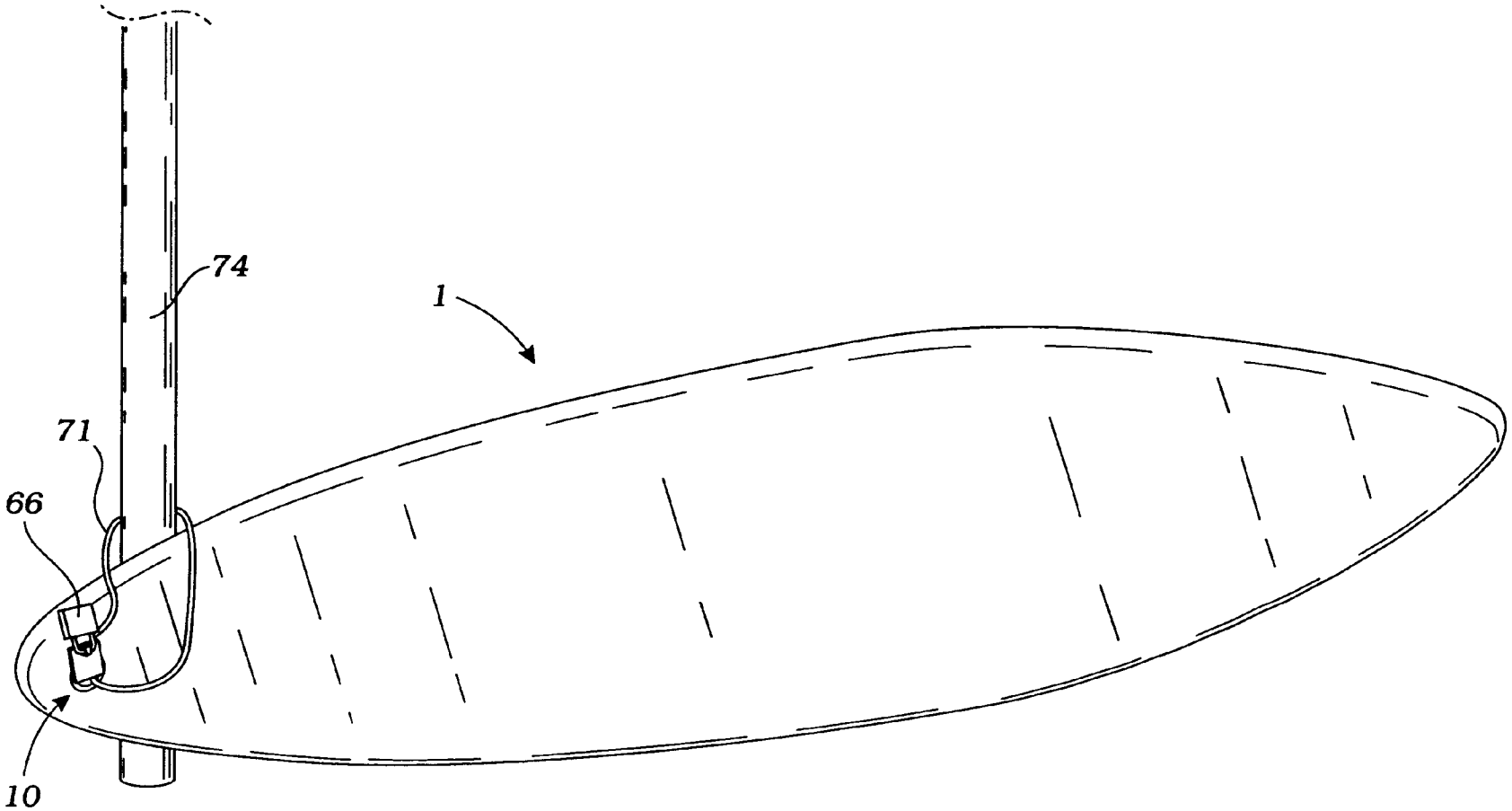
FIG. 4 is a perspective view of the locking apparatus illustrating a method for securing the engaged locking device to a stationary article.

Introduction of shackle 67 of padlock 66 into bore 39, while pin 63 and hook end 49 enclose cross bar 13, securely fixes locking apparatus 10 to board 1. As shown in FIG. 3, cable 71 becomes secured to padlock 66 by its interaction with shackle 67 and one or more hoop ends 73. In FIG. 4, the length of security cable not engaged with shackle 67 is attached to a stationary article such as security post 74. Upon inserting end 68 into lock housing 69, cable 71 connects lock mechanism 10 to stationary article 74 thereby securing sportsboard 1 from theft.

Thus, a method is described wherein a sportsboard 1 having a deck plug 7 and cross bar 13 features is securely engaged by a locking apparatus 10 via its interaction with a standard padlock 66 and shackle 67. Subsequent introduction of security cable 71 having one or more ends 73 facilitates securing the lock apparatus and board to a stationary article thereby providing a method of preventing theft of a sportsboard.

The locking apparatus 10 disclosed herein provides a positive engagement of sportsboard 1. The engagement is initiated by enclosing the deck plug's cross bar 13 within the space 631 formed by apparatus element 43 and the apparatus pin element 63 after it is inserted through central bores 41 and 51. This positive engagement is completed when the bore 39 of vertical member 31 accepts a padlock shackle 67 or other security device which fills bore 39's recess through the bore's cross section. When bore 39 is filled, vertical movement of second horizontal member 55 relative to first horizontal member 21 is prevented. Thus pin 63, after insertion through bores 41 and 51, is fixed in place enclosing cross bar 13 within the space 631 formed by pin 63 and hook element 43.

Means 53 firmly secures member 21 to hook element 43 and allows 21 and 43 to rotate or spin relative to each other about the axis of bore 51 and 41. Such axis is common with pin 63. Similarly, member 55 spins relative to hook 43. The low profile and rotate-able features of the invention's elements 21 and 55 do not permit a sportsboard thief to grip these apparatus 10 elements located above the board's surface 2 and twist-out cross bar 13 nor deck plug 7.

In the preferred embodiment, the footprint or area of member 21, and hence member 55, is sufficient to span the diameter of deck plug 7 and to overlap surface 2 such that lower surface 23 of member 21 in contact with board surface 2 provides resistance to damaging release efforts by thieves attempting to rock the lock apparatus free from the deck plug or to damage the cross bar and plug.

Further, since the cross bar is not firmly gripped or held tightly by lock apparatus 10, rather it is constrained within space 631 formed by pin 63 and hook 43, the rocking motion—release method used by sportsboard thieves is ineffective as the un-gripped cross bar is not affected by the rocking motion. Thus, one of the major shortcomings of prior sportsboard security apparatus designs is overcome by the non-gripped and rotate-able features of the present invention.

The preferred embodiment of the device described herein is comprised of few elements whose simple features interact with minimal reliance on close tolerance moving parts nor upon complex motion relative to each other, i.e. no spring loaded interactions nor toothed engagements. The interaction between elements is dominated by a rotate-able means 53 between elements 43 and 21 which is primarily dependent upon hook 43's ability to spin or rotate independent of elements 21 and 55. Thus, the device will not be adversely affected by the corrosive and abrasive nature of the environment in which these sportsboards are used, namely sand, dirt, salt water, and moisture. The low part count, simple features and simple assembly also translate into low cost materials, manufacture and assembly costs while attaining product life longevity.

That the hook element 43 and pin element 63 enclose the deck plug 7 cross bar to engage the lock apparatus 10 onto board 1 permits the apparatus to be used with a wide range of sportsboard deck plug designs. At a minimum, both flat ended cylindrical deck plugs and curved, spherical ended deck plugs will be readily engaged by the present invention. The cross bar directed interaction of pin 63 and hook element 43 insure compatibility of lock apparatus 10 with a multiplicity of sportsboard deck plug designs and features. Thus, custom and specific deck plug installation and modifications are avoided allowing for widespread application of the present invention to standard sportsboard features.

What is claimed is:

1. A locking apparatus for a sportsboard having a deck plug and comprising a cross-bar therein wherein the deck plug of the sportsboard has an opening having a predetermined opening area, wherein said locking apparatus comprises:

a hooking arrangement comprising:

a first horizontal member having a connecting bore and a size substantially larger than the opening area of the deck plug as so to substantially cover the opening of the deck plug completely; and a hook element having an upper portion and an engaging portion having a non-engaging opening, wherein said upper portion of said hook element is connected to a lower portion of said first horizontal member and said engaging portion substantially encloses the cross-bar of the deck plug such that said hook element is adapted for hooking the cross-bar of the deck plug in a lock position and is adapted for detaching from the cross-bar of the deck plug through said non-engaging opening in an unlock position;

a second horizontal member having a connecting portion detachably connected to said first horizontal member through said connecting bore and comprising a pin element extended from said connecting portion of said second horizontal member, wherein in said lock position, said pin element is adapted for substantially enclosing said non-engaging opening of said hook element and detachably connecting to said hook element securely at a predetermined position; and a vertical element connected to said first horizontal element for providing a locking place.

2. A locking apparatus, as recited in claim 1, wherein said hooking arrangement further comprises a connector having a predetermined length, wherein said lower portion of said first horizontal member is movably connected with said upper portion of said hook element by said connector.

3. A locking apparatus, as recited in claim 2, wherein said length of said connector is adjustable such that a distance between said first horizontal member and said hook element is capable of adjusting to fit the deck plug and the cross-bar of the deck plug.

4. A locking apparatus, as recited in claim 1, wherein said vertical element is integrally provided on an upper portion of said first horizontal element of said hooking arrangement.

5. A locking apparatus, as recited in claim 4, wherein said second horizontal member further has an element passage such that a lower portion of said vertical element is fittingly received in said passage and an upper portion of said vertical element is protruded outward for providing the locking place.

6. A locking apparatus, as recited in claim 1, wherein said second horizontal member and said first horizontal member are co-axially connected in a rotatable manner and said first horizontal member and said hook element is co-axially connected in a rotatable manner such that said first horizontal member, said second horizontal member and said hook element are capable of rotating with respect to the deck plug.

7. A locking apparatus, as recited in claim 1, wherein said second horizontal member and said first horizontal member are integrally connected.

8. A locking apparatus, as recited in claim 1, wherein said first horizontal member and said hooking member are integrally connected.

9. A locking apparatus, as recited in claim 1, wherein said engaging portion of said hook element is U-shaped.

10. A locking apparatus for a sportsboard having a deck plug and comprising a cross-bar therein wherein the deck plug of the sportsboard has an opening having a predetermined opening area, wherein said locking apparatus comprises:

a hook arrangement comprising:

a first horizontal member having a size substantially larger than the opening area of the deck plug as so to substantially cover the opening of the deck plug completely; and a hook element having an upper portion and an engaging portion having a non-engaging opening, wherein said upper portion of said hook element is connected to a lower portion of said first horizontal member and said engaging portion having a predetermined curvature substantially encloses the cross-bar of the deck plug such that said hook element is adapted for hooking the cross-bar of the deck plug in a lock position and is adapted for detaching from the cross-bar of the deck plug through said non-engaging opening in an unlock position;

a second horizontal member having an element passage detachably connected to said first horizontal element; and a vertical element connected securely to said first horizontal element for providing a locking place.

11. A locking apparatus, as recited in claim 10, wherein said vertical element has a lower portion fittingly received in said element passage and an enlarged portion protruded and extended from said first horizontal element such that when said first horizontal element and said second horizontal element are connected together in a lock position, a movement between the first horizontal element and said second horizontal element is prohibited.

12. A locking apparatus, as recited in claim 10, wherein said hook arrangement further comprises a connector having a predetermined length movably connected said lower portion of said first horizontal member with said upper portion of said hook element, wherein said length of said connector is adjustable such that a distance between said first horizontal member and said hook element is capable of adjusting to fit the deck plug and the cross-bar of the deck plug.

13. A locking apparatus for a sportsboard having a deck plug comprising a cross-bar therein wherein the deck plug of the sportsboard has an opening having a predetermined opening area, wherein said locking apparatus comprises:

a first horizontal member having a size substantially larger than the opening area of the deck plug so as to cover the opening of the deck plug;

a hook element having an upper portion and an engaging portion having a non-engaging opening, wherein said upper portion of said hook element is connected to a lower portion of said first horizontal member and said engaging portion substantially encloses the cross-bar of the deck plug such that said hook element is adapted for hooking the cross-bar of the deck plug in a lock position and is adapted for detaching from the cross-bar of the deck plug at said non-engaging opening in an unlock position;

a second horizontal member having a connecting portion detachably connected to said first horizontal member;

a first means for detachably connecting said second horizontal member to said hook element at a predetermined position through said first horizontal member such that said hook element is with said first horizontal member and said securely connected second horizontal member; and a second means for providing a locking place.

14. A locking apparatus, as recited in claim 13, wherein said first means is a pin element extended from said connecting portion of said second horizontal member, wherein in said lock position, said pin element is adapted for substantially enclosing said non-engaging opening of said hook element and detachable connecting to said hook element securely at a predetermined position.

15. A locking apparatus, as recited in claim 13, wherein said hook arrangement further comprises a connector having a predetermined length movably connected said lower portion of said first horizontal member with said upper portion of said hook element.

16. A locking apparatus, as recited in claim 15, wherein said length of said connector is adjustable such that a distance between said first horizontal member and said hook element is capable of adjusting to fit the deck plug and the cross-bar of the deck plug.

17. A locking apparatus, as recited in claim 13, wherein said second horizontal member and said first horizontal member is are co-axially connected in a rotatable manner and said first horizontal member and said hook element are co-axially connected in a rotatable manner such that said first horizontal member, said second horizontal member and said hook element are aligned co-axially in the locking position and are capable of rotating with respect to the deck plug.

18. A locking apparatus, as recited in claim 13, wherein said engaging portion of said hook element is U-shaped such that said hook element is fittingly enclosing the cross-bar of the deck plug substantially.

19. A locking apparatus, as recited in claim 13, wherein said second means for providing a locking place is a vertical element which is integrally provided on an upper portion of said first horizontal element.

20. A locking apparatus, as recited in claim 19, further having an element passage provided on said second horizontal member such that a lower portion of said vertical element is fittingly received in said passage and an upper portion of said vertical element is protruded outwardly for providing the locking place.

* * * * *